US006883416B2

(12) United States Patent
Koelzer et al.

(10) Patent No.: US 6,883,416 B2
(45) Date of Patent: Apr. 26, 2005

(54) SWASH PLATE CONTAINMENT ASSEMBLY

(75) Inventors: Robert L. Koelzer, Kearney, MO (US); Michael R. Jenkins, Kansas City, MO (US)

(73) Assignee: Haldex Brake Corporation, Kansas City, MO (US)

( * ) Notice: Subject to any disclaimer, the term of this patent is extended or adjusted under 35 U.S.C. 154(b) by 150 days.

(21) Appl. No.: 10/353,249

(22) Filed: Jan. 28, 2003

(65) Prior Publication Data

US 2004/0144246 A1 Jul. 29, 2004

(51) Int. Cl.[7] ..... F01B 3/10
(52) U.S. Cl. ..... 92/12.2; 92/71; 91/505
(58) Field of Search ..... 92/71, 12.2, 12.1; 91/505

(56) References Cited

U.S. PATENT DOCUMENTS

| | | | | | |
|---|---|---|---|---|---|
| 1,910,054 | A | * | 5/1933 | Rayburn | 91/505 |
| 3,230,893 | A | | 1/1966 | Hann et al. | |
| 3,319,874 | A | * | 5/1967 | Welsh | 92/12.2 |
| 4,152,946 | A | * | 5/1979 | Kemper | 475/166 |
| 4,497,284 | A | * | 2/1985 | Schramm | 60/607 |
| 5,027,755 | A | * | 7/1991 | Henry, Jr. | 123/56.4 |
| 5,095,807 | A | | 3/1992 | Wagenseil | |
| 5,105,728 | A | | 4/1992 | Hayase et al. | |
| 5,626,463 | A | | 5/1997 | Kimura et al. | |
| 6,439,857 | B1 | | 8/2002 | Koelzer et al. | |

FOREIGN PATENT DOCUMENTS

| | | | | |
|---|---|---|---|---|
| GB | 185295 | | 9/1922 | |
| JP | 63053196 | A * | 3/1988 | B63H/3/04 |

* cited by examiner

*Primary Examiner*—Edward K. Look
*Assistant Examiner*—Igor Kershteyn
(74) *Attorney, Agent, or Firm*—St. Onge Steward Johnston & Reens LLC

(57) ABSTRACT

A swash plate containment assembly for a compressor is disclosed generally comprising a housing, a drive shaft, a swash plate mounted on the drive shaft, and a gimbal arm connected to the housing and swash plate via rotatable joints. In certain embodiments, the joints are located approximately ninety degrees from each other. In some embodiments, the joints comprise a roller bearing and journal coupled thereto.

27 Claims, 6 Drawing Sheets

SWASH PLATE CONTAINMENT ASSEMBLY

FIELD OF THE INVENTION

The present invention relates to an apparatus for containing a swash plate. More specifically, the invention relates to a gimbal arm assembly for preventing a swash plate in a piston compressor from rotating with a drive shaft in the compressor.

BACKGROUND OF THE INVENTION

Swash plate axial piston compressors for generating compressed air for a variety of devices in motor vehicles are generally known. These compressors typically include a drive shaft, a cylinder block surrounding the drive shaft, which cylinder block has cylinder bores formed therein, and a plurality of pistons slidably disposed in the cylinder bores, wherein the pistons are successively reciprocated in the cylinder bores by a rotation of the drive shaft so that a suction stroke and a discharge stroke are alternately executed in each of the cylinder bores. One such device is disclosed in U.S. Pat. No. 5,626,463 to Kimura, which describes a cam plate member that rotates with a drive shaft, and a non-rotating wobble plate mounted on the cam plate that pivots in accordance with the rotating cam plate member, thereby axially displacing the pistons inside the bores.

One disadvantage of these compressors, however, is that the swash plate assemblies are complex and require a large number of parts. Additionally, compressors of this type require a relatively large space. Accordingly, in order to reduce the complexity of the design and reduce the number of parts used and space required, it has been proposed to use a swash plate air compressor employing pistons disposed in bores of a stationary cylinder block, wherein a non-rotatable swash plate pivots in accordance with the thrust exerted by an actuator, such as that disclosed in U.S. Pat. No. 6,439,857, which is assigned to the assignee of the present application and which is incorporated herein by reference.

However, in order to keep the swash plate from rotating along with the drive shaft, it is necessary to provide a mechanism that simultaneously permits the swash plate to pivot as described above, yet restrains the swash plate from moving rotationally. These mechanisms typically employ a ball or stopper, such as that disclosed in U.S. Pat. No. 6,439,857, that slides along a track or groove in the compressor housing.

These arrangements, however, have the disadvantage that they are not able to work effectively in an oil-free operation of the compressor, which is desired in order to prevent oil contamination of, for example, an airbrake system for which the compressor generates compressed air. Without the presence of oil to keep the surfaces lubricated, the continuous sliding of surfaces used to prevent the swash plate from rotating creates undesired friction that wears down these surfaces and impractically limits the life of the compressor.

Another disadvantage of these arrangements is that they cause the pistons to move erratically within the cylinder block, which creates several undesired effects. First, this will often lead to excessive wear of the pistons and the walls of the cylinder block. Second, it will require a greater piston to head clearance than would be required if the pistons moved smoothly within the cylinder block, which decreases the volumetric efficiency of the compressor.

What is desired, therefore, is an apparatus for restraining a swash plate from rotating with a drive shaft that permits oil-free operation of the compressor. What is further desired is an apparatus for restraining a swash plate from rotating with a drive shaft that increases the life of the containment device, the housing walls, the pistons, and the walls of the cylinder block. What is also desired is an apparatus for restraining a swash plate from rotating with a drive shaft that increases the volumetric efficiency of the compressor.

SUMMARY OF THE INVENTION

Accordingly, it is an object of the present invention to provide an axial piston compressor that permits oil-free operation of the compressor.

It is a further object of the present invention to provide an axial piston compressor that decreases the wear experienced by the containment device and walls of the housing that secures the containment device.

It is yet another object of the present invention to provide an axial piston compressor that decreases the wear experienced by the pistons and the walls of the cylinder block in which the pistons move.

It is still another object of the present invention to provide an axial piston compressor that increases the volumetric efficiency of the compressor.

To overcome the deficiencies of the prior art and to achieve at least some of the objects and advantages listed, the invention comprises a swash plate containment assembly, including a housing, a drive shaft disposed in the housing, a swash plate mounted on the drive shaft, which drive shaft is rotatable therein, a gimbal arm having a first end connected to the swash plate via a first rotatable joint and a second end connected to the housing via a second rotatable joint.

In another embodiment, the invention comprises a swash plate containment assembly, including a housing, a cylinder block connected to the housing, which cylinder block has at least one bore therein, at least one piston disposed in the at least one bore and slidable therein, a drive shaft disposed in the housing and cylinder block, a swash plate mounted on the drive shaft, and a gimbal arm having a first end connected to the swash plate via a first rotatable joint and a second end connected to the housing via a second rotatable joint.

DETAILED DESCRIPTION OF THE DRAWINGS

Figure 1:
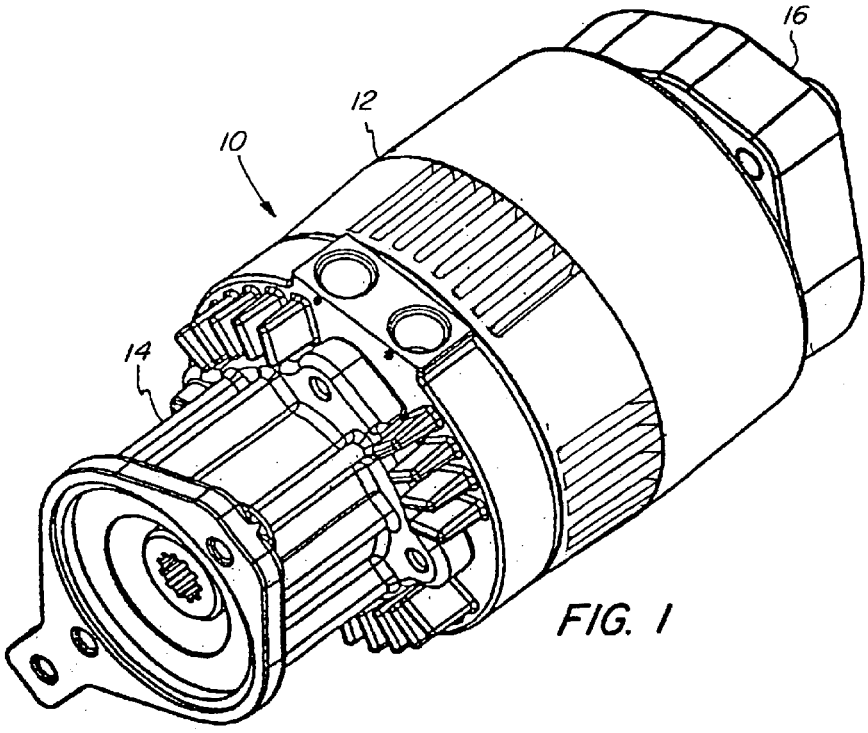
FIG. 1 is an isometric view of the axial piston compressor provided with a gimbal arm in accordance with the invention.

The basic components of one embodiment of an axial piston compressor 10 in accordance with the invention are illustrated in FIG. 1. As used in the description, the terms "top," "bottom," "upper," "lower," "front" and "rear" refer to the objects referenced when in the orientation illustrated in the drawings, which orientation is not necessary for achieving the objects of the invention.

Typically, the compressor 10 includes a main body 12, a rear mounting cover 14, and a front mounting flange 16. When in use, the compressor 10 is installed on a vehicle, such as an over-the-road truck, and generates compressed air for the vehicle's pressure system, which typically includes a tank (not shown) that supplies the compressed air to various accessories, such as, for example, the brake system. This production of the compressed air begins by receiving air, which may or may not be delivered from a turbocharger (not shown), in response to a reduction of the air pressure in the air system to or below a reference pressure.

Figure 2:
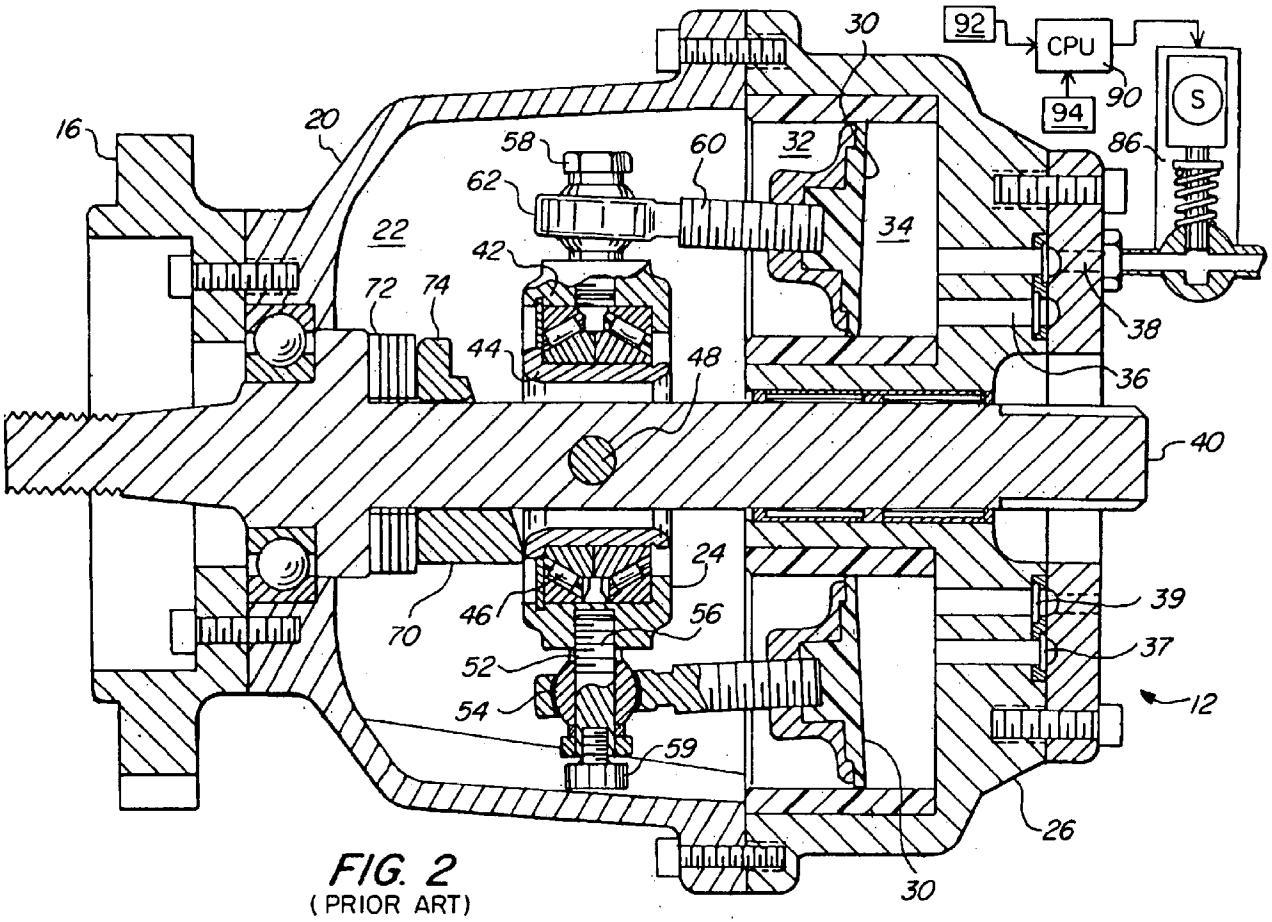
FIG. 2 (PRIOR ART)
FIG. 2 is an exposed side view of a compressor known in the prior art.
Figure 3:
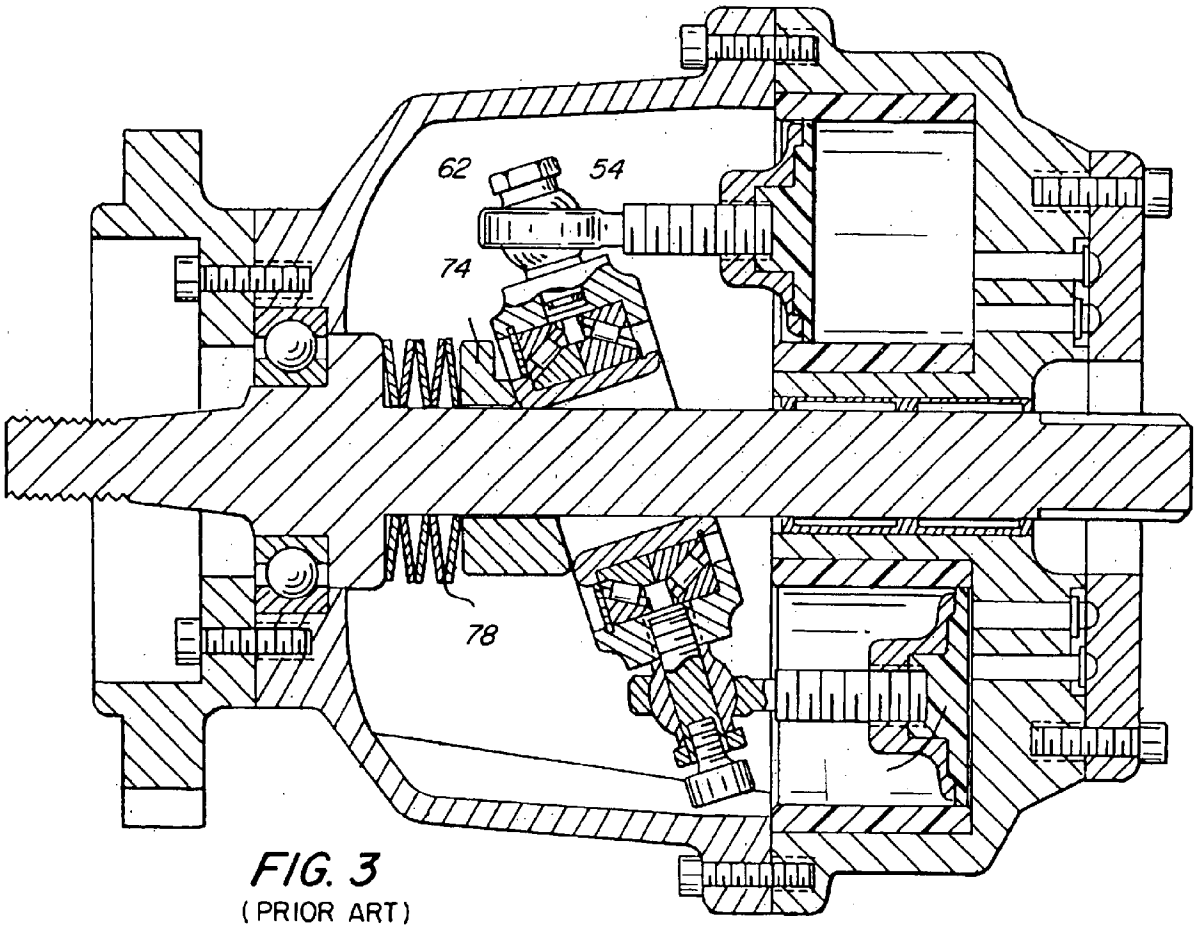
FIG. 3 (PRIOR ART)
FIG. 3 is an exposed side view of a compressor known in the prior art.

The basic components of one embodiment of the main body 12 of the compressor 10 are illustrated in FIGS. 2–3. The main body 12 includes a stationary housing 20 defining a crank chamber 22 therein, a swash plate 24 disposed in the crank chamber 22, and a stationary cylinder block 26 connected to the housing 20. A plurality of pistons 30 are coupled to the swash plate 24, and the cylinder block 26 has a plurality of bores 32 that receive the pistons 30. The pistons 30 are reciprocally displaceable within the bores 32 in order to provide for suction and compression strokes. A space 34 in the bores 32 above the pistons 30 is in fluid communication with the air system via a plurality of intake ports 36 and discharge ports 38. Accordingly, the air pressure in the space 34 corresponds to air pressure in the air system ensuring a state of pressure equilibrium for the compressor 10, as further explained below.

In order to provide fluid communication between the intake and discharge ports 36, 38, the compressor has a head plate (not shown) provided with a plurality of check valves 39, 37 preventing the back-feeding of the air to be discharged. In certain advantageous embodiments, the check valves may be of the reed or poppet varieties, allowing air to flow along a path from a high-pressure area to a low-pressure area. Thus, as the pressure in the air system downstream from the compressor 10 lowers, airflow is directed from the bores 32 to the air system through the valves 37 provided in the discharge ports 38. Accordingly, air pressure above the pistons 30 is lowered, thereby causing displacement of the swash plate 24 and the pistons 30. As a result, the suction stroke generates a negative pressure sufficient to allow air to enter the cylinder block 26 through the valves 39 provided in the intake ports 36.

In order to temporarily release the engine of the truck from an additional load under certain conditions, such as when a truck climbs up a steep hill, a solenoid 86 can close the discharge port 38 upon an on-demand signal from a driver. As a result, the pressure in the spaces 34 above the pistons 30 rapidly rises, enabling the compressor 10 to reach a state of equilibrium within a short period of time. Opening of the solenoid 86 allows the compressor 10 to return to a normal mode of operation.

Additionally, the vehicle is provided with a central processing unit 90 for receiving a signal that is generated by a pressure sensor 92 after air pressure in the air system has reached a predetermined upper threshold. Once this signal is processed, the solenoid 86 is actuated to block the discharge port 38.

Furthermore, the central processing unit 90, which is typically a computer, is able to process a signal indicating the overall load on the vehicle's engine. Thus, if a signal indicative of the load exceeds a certain threshold, the processing unit 90 generates a pilot signal actuating the solenoid 86, which closes the discharge port 38. In this case, the compressor rapidly achieves a state of equilibrium, as explained above, and stops compressing air.

Since the reciprocal motion of the pistons is arrested after the state of equilibrium is reached, the need for lubrication between the pistons 30 and the cylinder block 26 is reduced. In certain embodiments, in order to decrease the need the lubrication even further, the bores 32 and pistons 30 are coated with wear-resistant materials. Accordingly, the pistons 30 may, for example, be coated with a material selected from the group including a PTFE material filled with bronze and Molybdenum Disulfide and a PTFE material filled with graphite and PPS, and an anodized aluminum coating (close to 60RC hardness) may be applied to the surfaces of the bores 32. Accordingly, with the appropriate selection of coating materials, along with the controllable motion of the pistons 30, lubrication between the pistons 30 and the walls of the cylinder block 26 is not necessary.

The swash plate 24 and cylinder block 26 each have a hole in the center thereof, which, collectively, form a channel in which a drive shaft 40 is disposed. The entire swash plate 24 is pivotal with respect to the shaft 40. A mechanism for translating pivotal displacement of the swash plate 24 to reciprocal axial displacement of the pistons 30 includes a plurality of ball links, each of which is comprised of a rod 52 and a ball element 54. In certain embodiments, the rods 52, which are spaced angularly equidistantly from one another along an outer periphery of the swash plate 24 and extend radially therefrom, are bolts having a thread 56 on one end and a nut 58 on the opposite end. The ball element 54 has a spherical outer surface slidably engaging a piston rod 60, which extends parallel to the rotating shaft 40, for synchronous axial displacement while allowing the piston rod 60 and ball element 54 to be angularly displaced relative to one another.

To displace the pistons 30 and swash plate 24 relative to one another as the swash plate 24 pivots, each piston rod 60 has a flange 62, the inner surface of which cooperates with an outer extremity of the ball element 54. Accordingly, as the swash plate 24 is angularly displaced from a position perpendicular to the drive shaft 40, the cooperating surfaces of the ball element 54 and flange 62 slide relative to one another. Such relative displacement allows the piston rod 60 and ball element 54 to move axially together, while the ball element 54 rotates within the flange 62 in response to the angular motion of the swash plate 24. Though the cooperating surfaces of the ball element 54 and flange 62 are depicted as annular, in certain embodiments, other shapes may be used, provided these elements move synchronously while being angularly displaced relative to one another.

The pistons 30 are idle in a state of pressure equilibrium when a piston-generated force acting upon a swash plate 24 and corresponding to the air pressure in the space 34 above the pistons 30 is equal and oppositely directed to a thrust generated by an actuator 70 against the swash plate 24. This state of equilibrium occurs when the swash plate 24 is in a substantially perpendicular position with respect to the axis of a drive shaft 40. Once the balance of air pressure has been disturbed, the thrust from the actuator 70 exceeds the lowered piston-generated force to angularly displace the swash plate 24 from its perpendicular position. As a result, the pistons 30 begin to reciprocally move in the bores 32, as will be further explained below. Thus, the more the air pressure in the air system drops, the larger the angular displacement of the swash plate 24 and the longer the strokes of the pistons 30.

The swash plate 24 pivots about a pin 48 upon a thrust exerted by the actuator 70. In certain advantageous embodiments, the actuator 70 includes a resilient element 72, such as, for example, Belleville washers, and a cam collar 74. The washers 72 are connected to the cam collar 74, which has a slanted cam surface with respect to the shaft 40, an extended part of which is always in contact with the swash plate 24. The swash plate 24 is always under pressure existing above the pistons 30, and thus, in order to maintain the swash plate 24 in a position perpendicular to the shaft 40 during the state of equilibrium, the cam collar 74 must continuously preload the swash plate 24. However, this contact in the state of equilibrium does not generate a thrust sufficient to overcome the pressure above the pistons 30 and pivot the swash plate 24. In operation, the washers 72 expand in response to the pressure drop in the air system to or below the reference value. As a result, the cam collar 74 is axially displaced to pivot the swash plate 24, the movement of which generates the suction and compression strokes of the pistons 30.

Although the actuator 70 is shown rotatably mounted on the shaft 40, in certain embodiments, the actuator 70 can be mounted on the housing 20. Further, in certain embodiments, other types of resilient elements, such as different types of compression springs 78, such as, for example, bellows, are used instead of the Belleville washers described above. In other embodiments, the actuator includes a servo piston (not shown), which is actuated in response to a pilot signal representing the reference value of the air system's pressure and generated by an external source once the pressure falls down to or below a threshold. The servo piston, which is attached to a mechanical link such as a fork, displaces the cam collar 74 to exert a thrust to pivotally displace the swash plate 24.

Because the drive shaft 40 is rotatably disposed in the swash plate 24, rather than integrally formed therewith or fixedly connected thereto, the shaft 40 continues to rotate even when the pistons 30 are idle and the compressor 10 is not compressing air. As a consequence, accessories coupled to the shaft 40, such as, for example, a fuel pump, continue to function.

This arrangement is possible by employing a swash plate 24 having an outer part 42 connected to a rotatable inner part 44 via a bearing assembly 46. The inner part 42 is mounted on the shaft 40 via the pin 48, such that the inner part 44 rotates with the shaft 40. As a result, as the shaft 40 rotates, the outer part 42 of the swash plate 24 can be restrained from rotating with the shaft 40.

Figure 6:
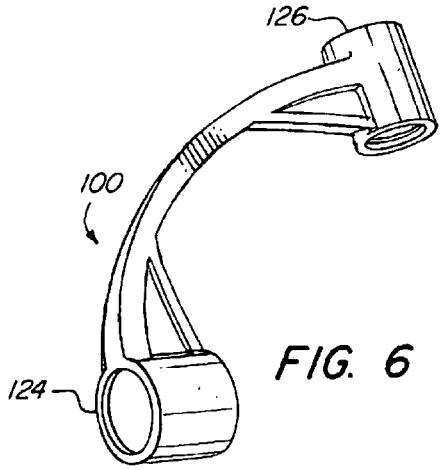
FIG. 6 is an isometric view of the gimbal arm shown in the compressor of FIGS. 4–5.
Figure 4:
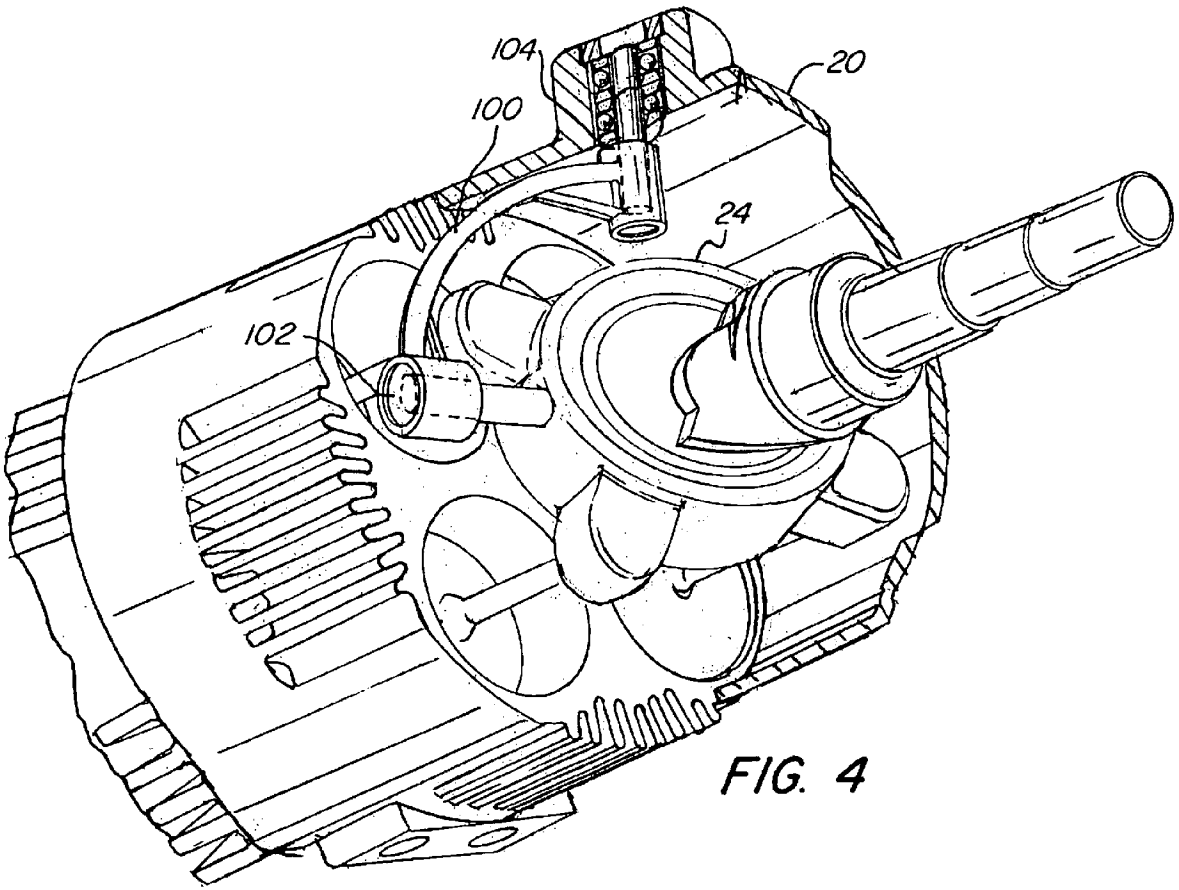
FIG. 4 is an exposed, perspective view of the compressor of FIG. 1.
Figure 5:
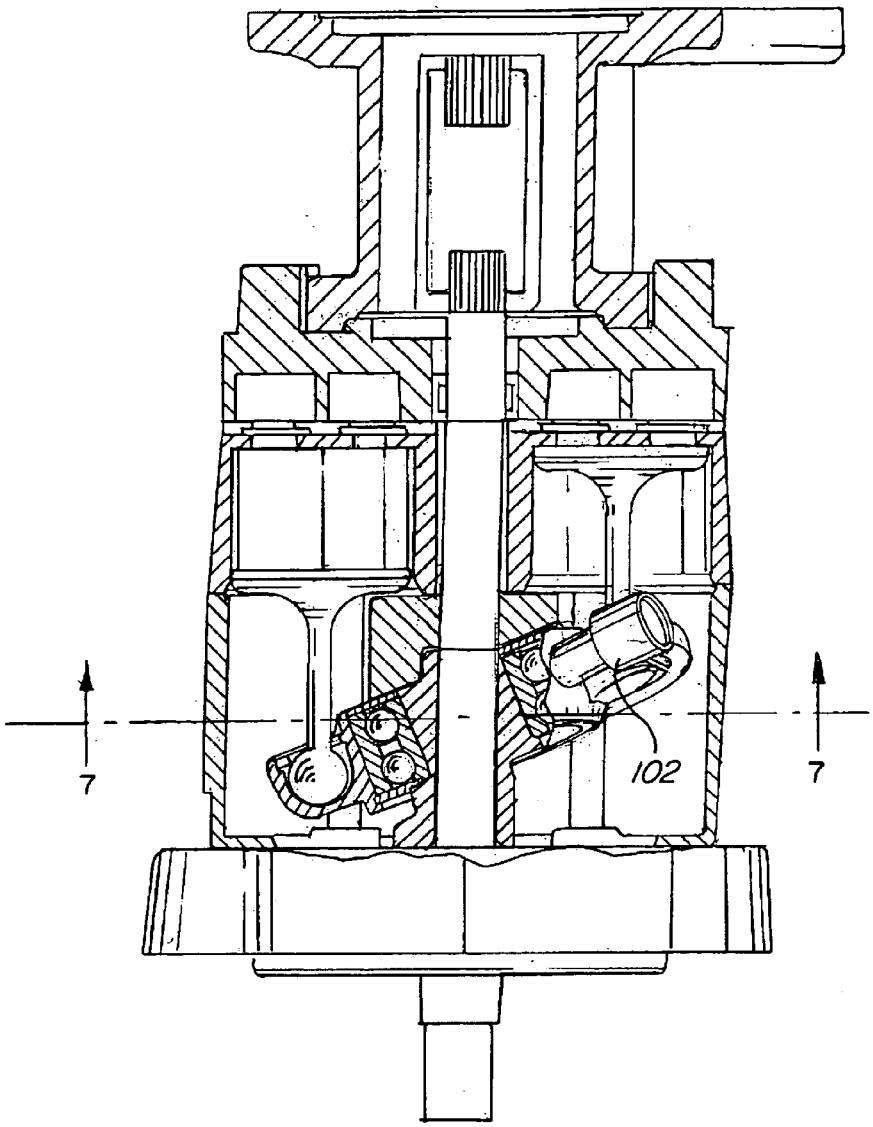
FIG. 5 is an exposed, plan view of the compressor of FIG. 4.

As illustrated in FIGS. 4–5, in order to prevent the outer part 42 of the swash plate 24 from rotating, a gimbal arm 100 (shown in more detail in FIG. 6) is simultaneously connected to the swash plate 24 by a first rotatable joint 102 and to the housing 20 via a second rotatable joint 104. In certain advantageous embodiments, the rotational axis of the first rotatable joint 102 is located at a ninety degree angle from the rotational axis of the second rotatable joint 104 relative to the rotational axis of the drive shaft 40.

By permitting the gimbal arm 100 to rotate about two perpendicular axes, the swash plate 24 is free to pivot about the pin 48 in any radial direction, and thus, the swash plate 24 is never restrained from pivoting as the actuator 70 continually exerts a thrust upon the swash plate 24 throughout the course of a full three hundred and sixty degree rotation. However, because the gimbal arm 100 is able to rotate along only these two rotational axes, it does not rotate along the rotational axis that is perpendicular to these two axes—i.e. the rotational axis of the drive shaft 40. As a result, the gimbal arm 100 prevents the swash plate from rotating along the rotational axis of the drive shaft 40, and thus, restrains the swash plate 24 from rotating with the shaft 40.

Figure 7:
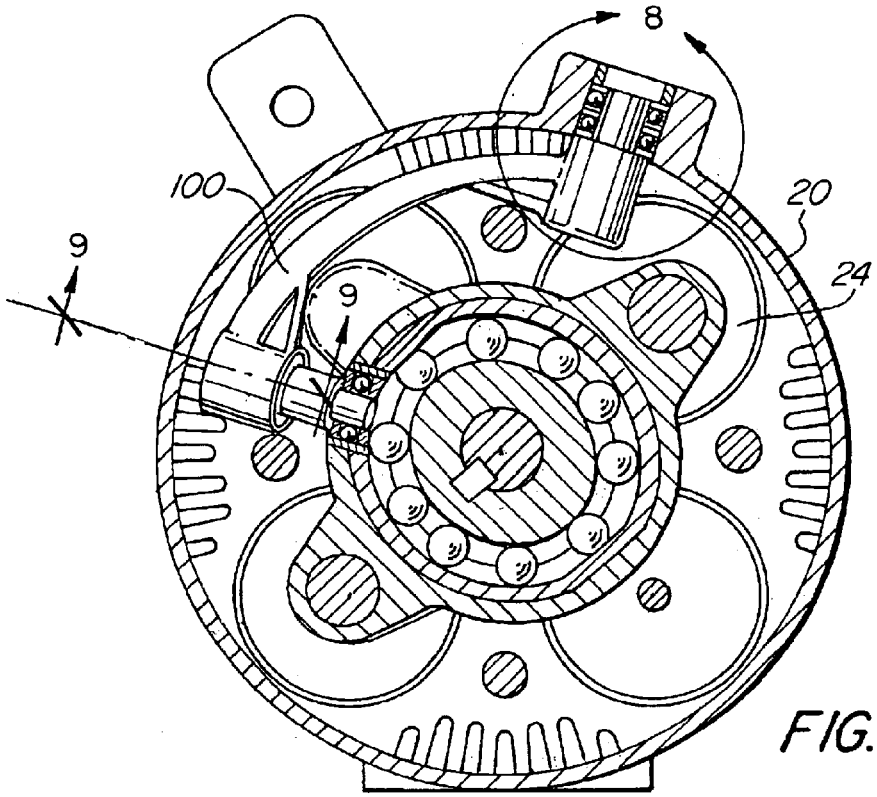
FIG. 7 is an exposed elevational view of the compressor of FIGS. 4–5.
Figure 8:
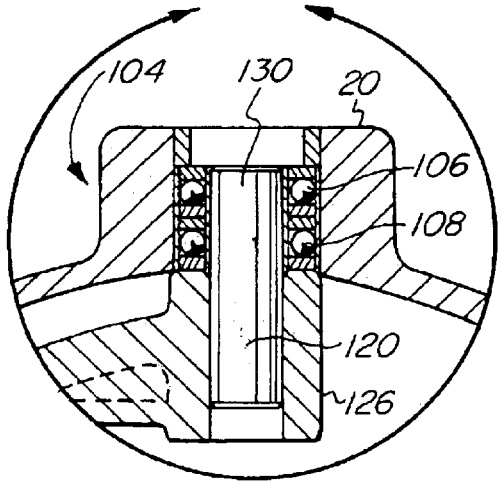
FIG. 8 is an enlarged view of a portion of FIG. 7.
Figure 9:
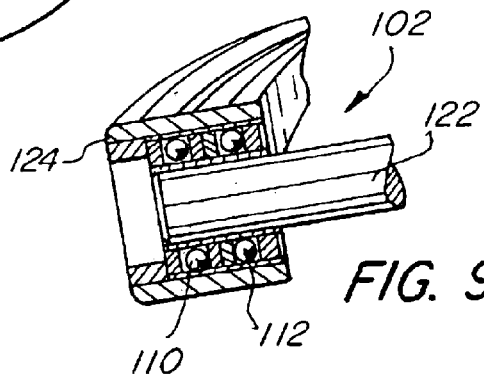
FIG. 9 is an enlarged view of another portion of FIG. 7.

As illustrated in FIGS. 7–9, in certain advantageous embodiments, the rotatable joints 102, 104 each include at least one roller bearing 106, 110 and a journal 120, 122 disposed therein. In this way, the oil needed to facilitate the rotation of the gimbal arm 100, which oil is located within the roller bearing 106, 110, is isolated from the rest of the compressor 10, thereby decreasing the likelihood of oil contamination of the compressed air ultimately supplied to various vehicle accessories. In certain advantageous embodiments, instead of a single bearing 106, a plurality of roller bearings 106, 108 are used for each rotatable joint 102, 104.

In certain advantageous embodiments, the ends of the gimbal arm 100 include inner and outer journal caps 124, 126, respectively, in which the journals 122, 120 are disposed, to which they are connected, or of which they form an integral part. Accordingly, several alternatives are available for creating rotatable joints 102, 104. For example, as illustrated in FIGS. 7 & 8, a cavity 130 in the housing 20 or swash plate 24 may include the roller bearings 106, 108 and thus, the journal 120 is rotatably disposed in the cavity 130 to create the joint 104. In other embodiments, as shown in FIGS. 7 & 9, the journal cap 124 may include the roller bearings 110, 112. Hence, the journal 122, which is coupled with, connected to, or an integral part of, the swash plate 24 or housing 20, is rotatably disposed in the journal cap 124.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A swash plate containment assembly, comprising:

a housing;

a drive shaft disposed in said housing;

a swash plate mounted on said drive shaft; and an arcuate gimbal arm having a first end connected to said swash plate via a first rotatable joint and a second end connected to said housing via a second rotatable joint.

2. The swash plate containment assembly as claimed in claim 1, wherein said swash plate includes a rotating member, which rotates with said drive shaft, and a non-rotating member, which is restrained from rotating with said drive shaft by said gimbal arm.

3. The swash plate containment assembly as claimed in claim 2, wherein said rotating member is coupled to said non-rotating member via a bearing.

4. The swash plate containment assembly as claimed in claim 1, wherein the rotational axis of the first rotatable joint is substantially perpendicular to the rotational axis of the second rotatable joint.

5. The swash plate containment assembly as claimed in claim 1, wherein at least one of the first and second rotatable joints comprises:

a roller bearing; and a journal coupled to said roller bearing.

6. The swash plate containment assembly as claimed in claim 5, wherein said swash plate includes a cavity into which said journal is disposed.

7. The swash plate containment assembly as claimed in claim 6, wherein said roller bearing is located in said cavity.

8. The swash plate containment assembly as claimed in claim 5, wherein said housing includes a cavity into which said journal is disposed.

9. The swash plate containment assembly as claimed in claim 8, wherein said roller bearing is located in said cavity.

10. The swash plate containment assembly as claimed in claim 5, wherein said first end of said gimbal arm comprises an inner journal cap into which said journal is disposed.

11. The swash plate containment assembly as claimed in claim 10, wherein said roller bearing is located in said cap.

12. The swash plate containment assembly as claimed in claim 5, wherein said second end of said gimbal arm comprises an outer journal cap into which said journal is disposed.

13. The swash plate containment assembly as claimed in claim 12, wherein said roller bearing is located in said cap.

14. A swash plate containment assembly, comprising:

a housing;

a cylinder block connected to said housing, which cylinder block has at least one bore therein;

at least one piston disposed in said at least one bore and slidable therein;

a drive shaft disposed in said housing and cylinder block;

a swash plate mounted on said drive shaft; and an arcuate gimbal arm having a first end connected to said swash plate via a first rotatable joint and a second end connected to said housing via a second rotatable joint.

15. The swash plate containment assembly as claimed in claim 14, further comprising an actuator contacting said swash plate, such that said actuator, in a first position, exerts a force on said swash plate appropriate to retain said swash plate in a position perpendicular to said drive shaft, such that said at least one piston remains idle, and, in a second position, exerts a force on said swash plate appropriate to pivot said swash plate, thereby causing reciprocal motion of said at least one piston.

16. The swash plate containment assembly as claimed in claim 14, wherein said swash plate includes a rotating member, which rotates with said drive shaft, and a non-rotating member, which is restrained from rotating with said drive shaft by said gimbal arm.

17. The swash plate containment assembly as claimed in claim 16, wherein said rotating member is coupled to said non-rotating member via a bearing.

18. The swash plate containment assembly as claimed in claim 14, wherein the rotational axis of the first rotatable joint is substantially perpendicular to the rotational axis of the second rotatable joint.

19. The swash plate containment assembly as claimed in claim 14, wherein at least one of the first and second rotatable joints comprises:

a roller bearing; and a journal coupled to said roller bearing.

20. The swash plate containment assembly as claimed in claim 19, wherein said swash plate includes a cavity into which said journal is disposed.

21. The swash plate containment assembly as claimed in claim 20, wherein said roller bearing is located in said cavity.

22. The swash plate containment assembly as claimed in claim 19, wherein said housing includes a cavity into which said journal is disposed.

23. The swash plate containment assembly as claimed in claim 22, wherein said roller bearing is located in said cavity.

24. The swash plate containment assembly as claimed in claim 19, wherein said first end of said gimbal arm comprises an inner journal cap into which said journal is disposed.

25. The swash plate containment assembly as claimed in claim 24, wherein said roller bearing is located in said cap.

26. The swash plate containment assembly as claimed in claim 19, wherein said second end of said gimbal arm comprises an outer journal cap into which said journal is disposed.

27. The swash plate containment assembly as claimed in claim 26, wherein said roller bearing is located in said cap.

* * * * *